US006860416B1

(12) United States Patent
Chen

(10) Patent No.: US 6,860,416 B1
(45) Date of Patent: Mar. 1, 2005

(54) SINGLE-SHOT NAIL STAPLER

(75) Inventor: Mu-Yu Chen, Taichung (TW)

(73) Assignee: Aplus Pneumatic Corp., Taichung Hsien (TW)

( * ) Notice: Subject to any disclaimer, the term of this patent is extended or adjusted under 35 U.S.C. 154(b) by 0 days.

(21) Appl. No.: 10/694,096

(22) Filed: Oct. 27, 2003

(51) Int. Cl.[7] ..... B25C 1/04
(52) U.S. Cl. ..... 227/8; 227/130
(58) Field of Search ..... 227/8, 130, 10; 123/46 SC

(56) References Cited

U.S. PATENT DOCUMENTS 5,551,621 A * 9/1996 Vallee ..... 227/8
5,791,545 A * 8/1998 Lin ..... 227/8
5,836,501 A * 11/1998 Lai ..... 227/8
6,116,488 A * 9/2000 Lee ..... 227/8
6,213,372 B1 * 4/2001 Chen ..... 227/8
6,422,446 B1 * 7/2002 Liu ..... 227/8
6,588,642 B1 * 7/2003 Wang et al. ..... 227/8
6,659,324 B1 * 12/2003 Liu ..... 227/8
6,662,989 B1 * 12/2003 Chang et al. ..... 227/8
6,675,999 B2 * 1/2004 Mukoyama et al. ..... 227/8

* cited by examiner

*Primary Examiner*—Scott A. Smith
(74) *Attorney, Agent, or Firm*—Alan D. Kamrath; Nikolai & Mersereau, P.A.

(57) ABSTRACT

A single-shot nail stapler includes a valve and a valve-opening rod for pushing the valve open. A major trigger includes two side members each with an upper portion pivotally attached to a portion of the single-shot nail stapler and a lower portion defining a substantially horizontal slit and a substantially vertical slot with an upper end and a lower end. A slide includes two side members each including a fin formed thereon and defining an inclined slot with an upper left end and a lower right end. The fins are movable in the substantially horizontal slits of the major trigger. A secondary trigger includes an upper portion, a lower portion and an aperture defined in the lower portion of the secondary trigger. A pin is fit in the aperture of the secondary trigger and movable in the inclined slots of the slide and the substantially vertical slots of the major trigger. Two springs are each compressed between the major trigger and each of the slide members of the slide. A security element extends movably between the side members of the major trigger for pushing the upper portion of the secondary trigger.

4 Claims, 13 Drawing Sheets

SINGLE-SHOT NAIL STAPLER

FIELD OF INVENTION

The present invention relates to a single-shot nail stapler.

BACKGROUND OF INVENTION

A conventional nail stapler includes a valve, a valve-opening rod, a trigger and a security element. The trigger must be pulled and the security element must be pressed against a piece of wood for example in order to push the valve-opening rod so as to open the valve. The valve-opening rod is pushed as long as the trigger is pulled and the security element is pressed, no matter which action is taken first. Hence, a user often pulls the trigger all the time and presses the security element against a piece of wood whenever he or she wants to shoot a nail. Thus, the security element becomes a de facto trigger. Moreover, every time the nail stapler shoots a nail at a spot, it vibrates. This vibration might cause the nail stapler to jump on the piece of wood. The user might immediately press the security element against the piece of wood because of inertia so as to shoot another nail at a spot very close to the previous spot. This wastes nails and damages the surface of the piece of wood.

Referring to FIGS. 9 to 12, a conventional single-shot nail stapler 67 includes a valve (not shown), a valve-opening rod 68, a major trigger 70, a security element 72, a spring 76 and a secondary trigger 60. The valve-opening rod 68 is movable. The major trigger 70 is pivotal. The security element 72 is movable. The major trigger 70 defines an aperture 74 through which the security element 72 extends.

Referring to FIGS. 13 and 14, the secondary trigger 60 includes a loop 62 formed at a first end and two branches 64 formed at a second end. A cutout 66 is defined between the branches 64.

Referring to FIG. 9, the spring 76 is compressed between an appropriate portion of the nail stapler 67 and the secondary trigger 60. A pin (not show) is forced into the major trigger 70 through the loop 62 so as to pivotally connect the major trigger 70 with the secondary trigger 60.

Referring to FIG. 10, the security element 72 is pressed so as to push the second end of the secondary trigger 60, thus bringing the secondary trigger 60 into contact with the valve-opening rod 68. Then, the major trigger 70 is pulled so as to move the loop 62, thus causing the secondary trigger 60 to push the valve-opening rod 68. Thus, the nail stapler 67 shoots a nail.

Referring to FIG. 11, the security element 72 is released while the major trigger 70 is still pulled. As biased by the spring 76, the secondary trigger 60 is pivoted about the pin. Thus, the second end of the secondary trigger 60 is moved beyond the security element 72.

Referring to FIG. 12, the security element 72 is pressed again and the major trigger 70 is still pulled. As the second end of the secondary trigger 60 is moved beyond the security element 72, the second end of the secondary trigger is not pushed by means of the security element 72. Hence, the valve-opening rod 68 is not pushed. Thus, the nail stapler 67 does not shoot another nail.

As mentioned above, the conventional single-shot nail stapler 67 can provide a single-shot function. However, it might fail to provide the single-shot function in at least two situations. Firstly, if the major trigger 70 is not pulled hard so that the second end of the secondary trigger 60 is not moved beyond the security element 72. Secondly, if the secondary trigger 60 is moved from its normal position so that one of the branches 64 abuts against the security element 72.

The present invention is therefore intended to obviate or at least alleviate the problems encountered in prior art.

SUMMARY OF INVENTION

The primary objective of the present invention is to provide a reliable single-shot nail stapler.

According to the present invention, a single-shot nail stapler includes a valve and a valve-opening rod for pushing the valve open. A major trigger includes two side members each with an upper portion pivotally attached to a portion of the single-shot nail stapler and a lower portion defining a substantially horizontal slit and a substantially vertical slot with an upper end and a lower end. A slide includes two side members each including a fin formed thereon and defining an inclined slot with an upper left end and a lower right end. The fins are movable in the substantially horizontal slits of the major trigger. A secondary trigger includes an upper portion, a lower portion and an aperture defined in the lower portion of the secondary trigger. A pin is fit in the aperture of the secondary trigger and movable in the inclined slots of the slide and the substantially vertical slots of the major trigger. Two springs are each compressed between the major trigger and each of the slide members of the slide. A security element extends movably between the side members of the major trigger for pushing the upper portion of the secondary trigger.

Other objects, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
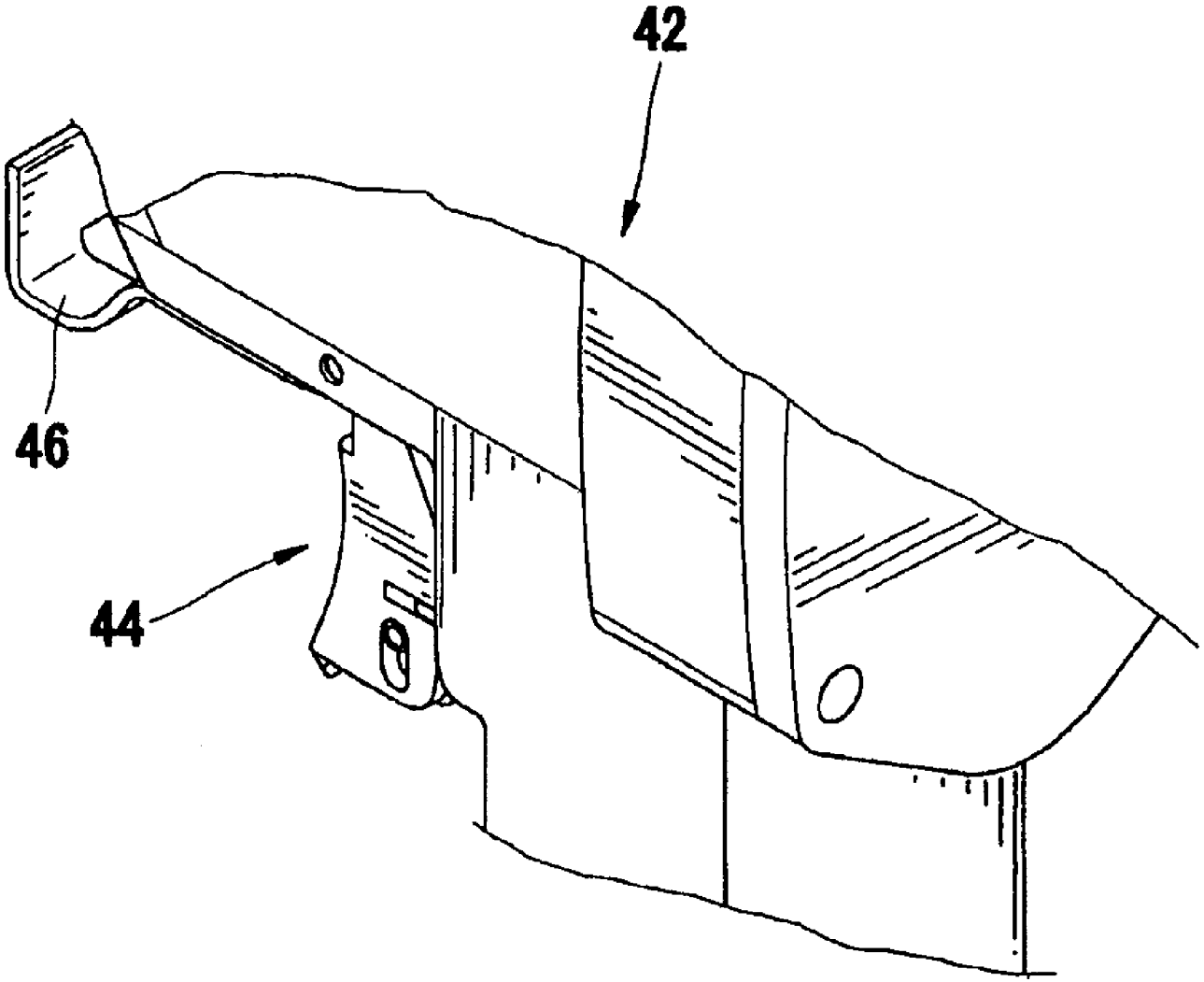
FIG. 1 is a perspective partial view of a nail stapler according to the preferred embodiment of the present invention.

Referring to FIGS. 1 to 8, according to the preferred embodiment of the present invention, a single-shot nail stapler 42 includes a valve 47, a valve-opening rod 48, a trigger assembly 44 and a security element 46. The valve 47 is switched between a closed mode and an open mode. Normally, the valve 47 is in the closed mode. To shoot a nail, the valve 47 is switched to the open mode. Pressurized air is sent from a pump (not shown) to a firing element (not shown) through the valve 47 in the open mode. To switch the valve 47 to the open mode, the valve-opening rod 48 is pushed. To push the valve-opening rod 48, the security element 46 and the trigger assembly 44 are operated subsequently. The above-mentioned elements of the single-shot nail stapler 42 other than the trigger assembly 44 will not be described in detail for being conventional.

Figure 2:
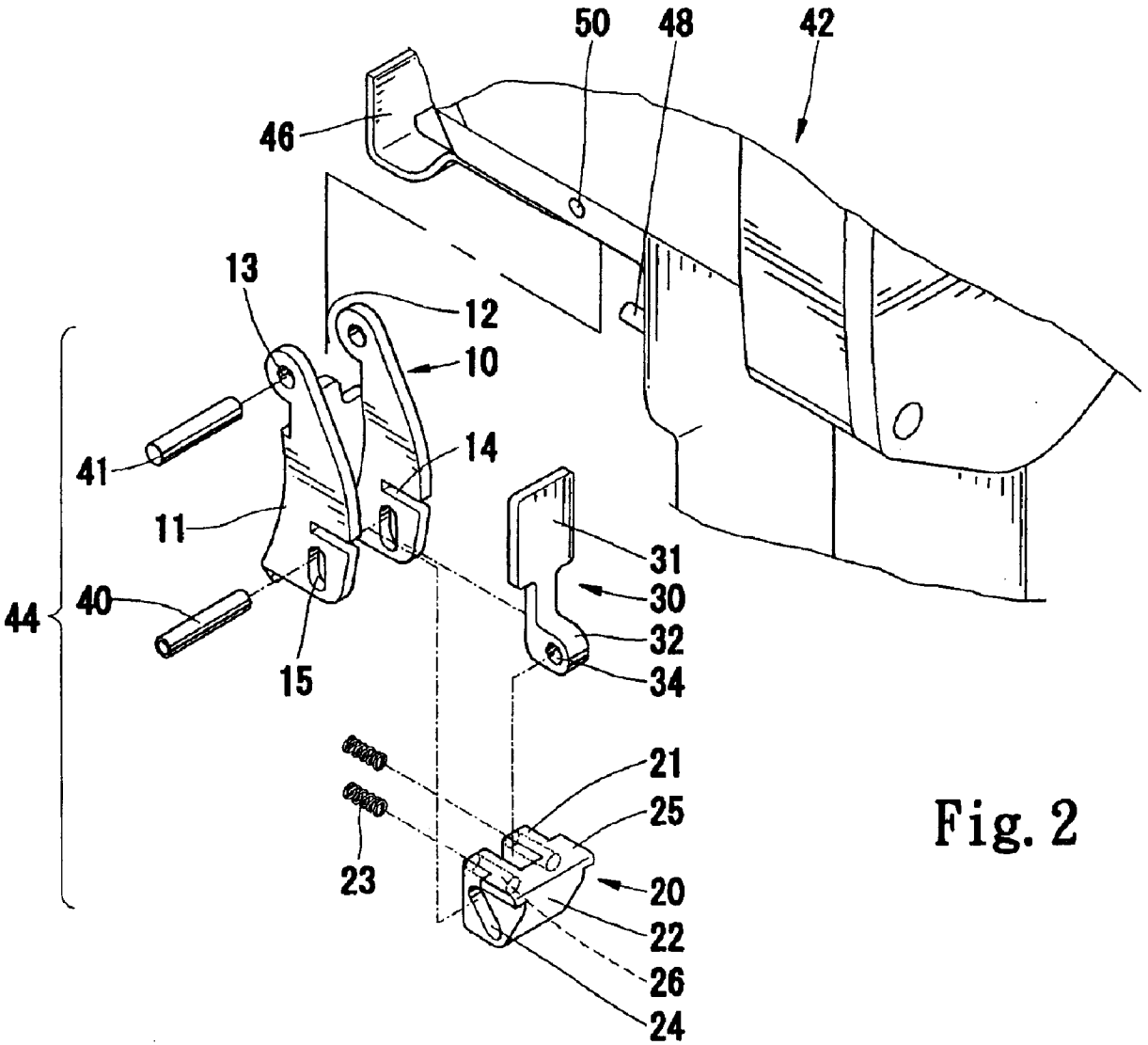
FIG. 2 is an exploded view of the nail stapler of FIG. 1.

Referring to FIG. 2, the trigger assembly 44 includes a major trigger 10, a slide 20, two springs 23 and a secondary trigger 30.

The secondary trigger 30 includes an upper portion 31 for contact with the security element 46 and a lower portion 32 for connection with the slide 20 and the major trigger 10. Preferably, the upper portion 31 of the secondary trigger 30 is a flat portion. Preferably, the lower portion 32 of the secondary trigger 30 defines an aperture 34.

The slide 20 includes two side members 21 and a middle member 22 formed between the side members 21. A fin 25 extends from each side 11 member 21. Each side member 21 defines an inclined slot 24 and a substantially horizontal hole 26. The slot 24 includes an upper left end and a lower right end.

The major trigger 10 includes two side members 11 and a middle member 12 formed between the side members 11. Each side member 11 includes an upper portion extending beyond the middle member 12. An aperture 13 is defined in the upper portion of each side member 11. A substantially horizontal slit 14 is defined in each side member 11. Also in each side member 11 is defined a substantially vertical slot 15 below the substantially horizontal slit 14.

Figure 3:
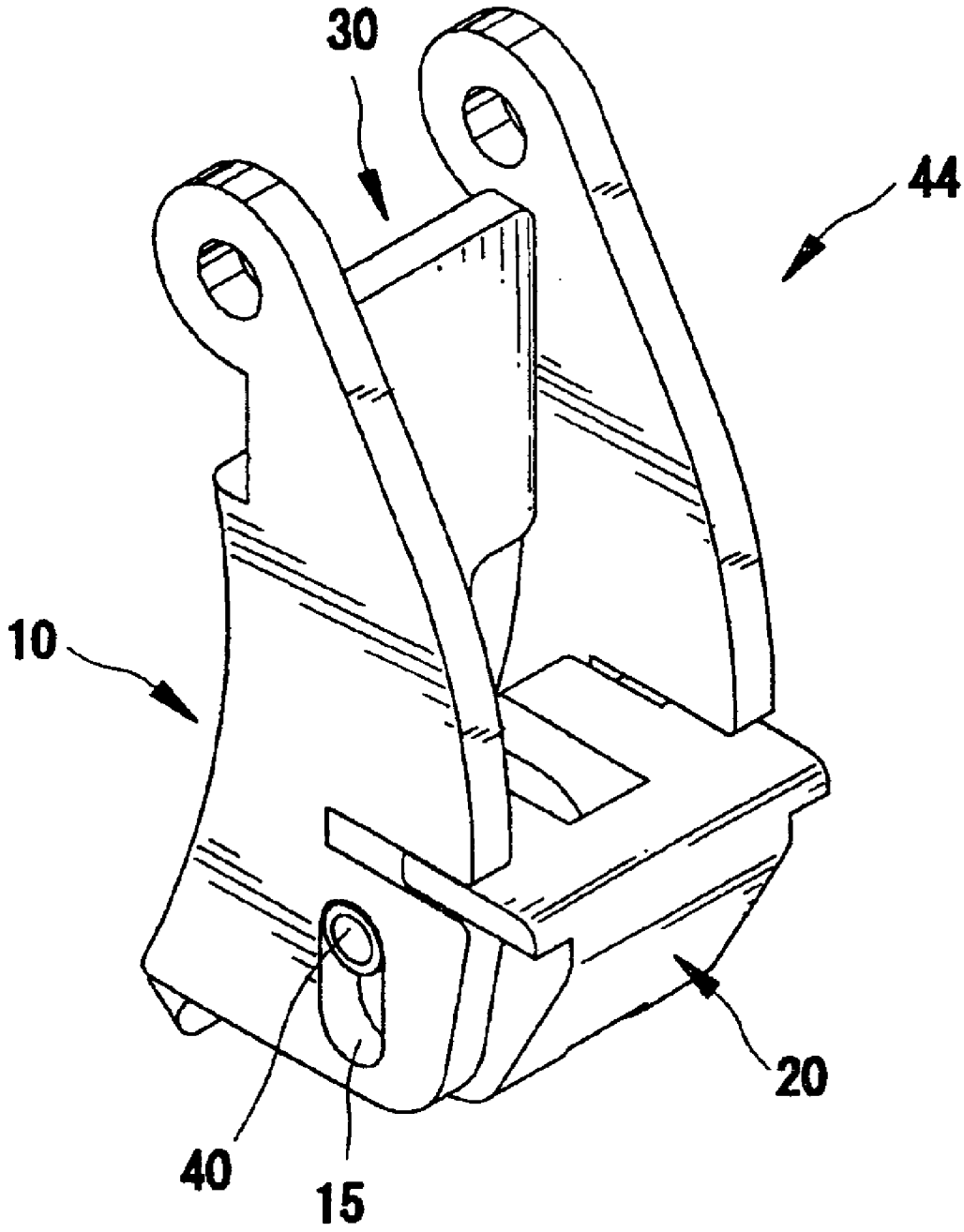
FIG. 3 is a perspective view of a trigger assembly for use in the nail stapler of FIG. 1.
Figure 4:
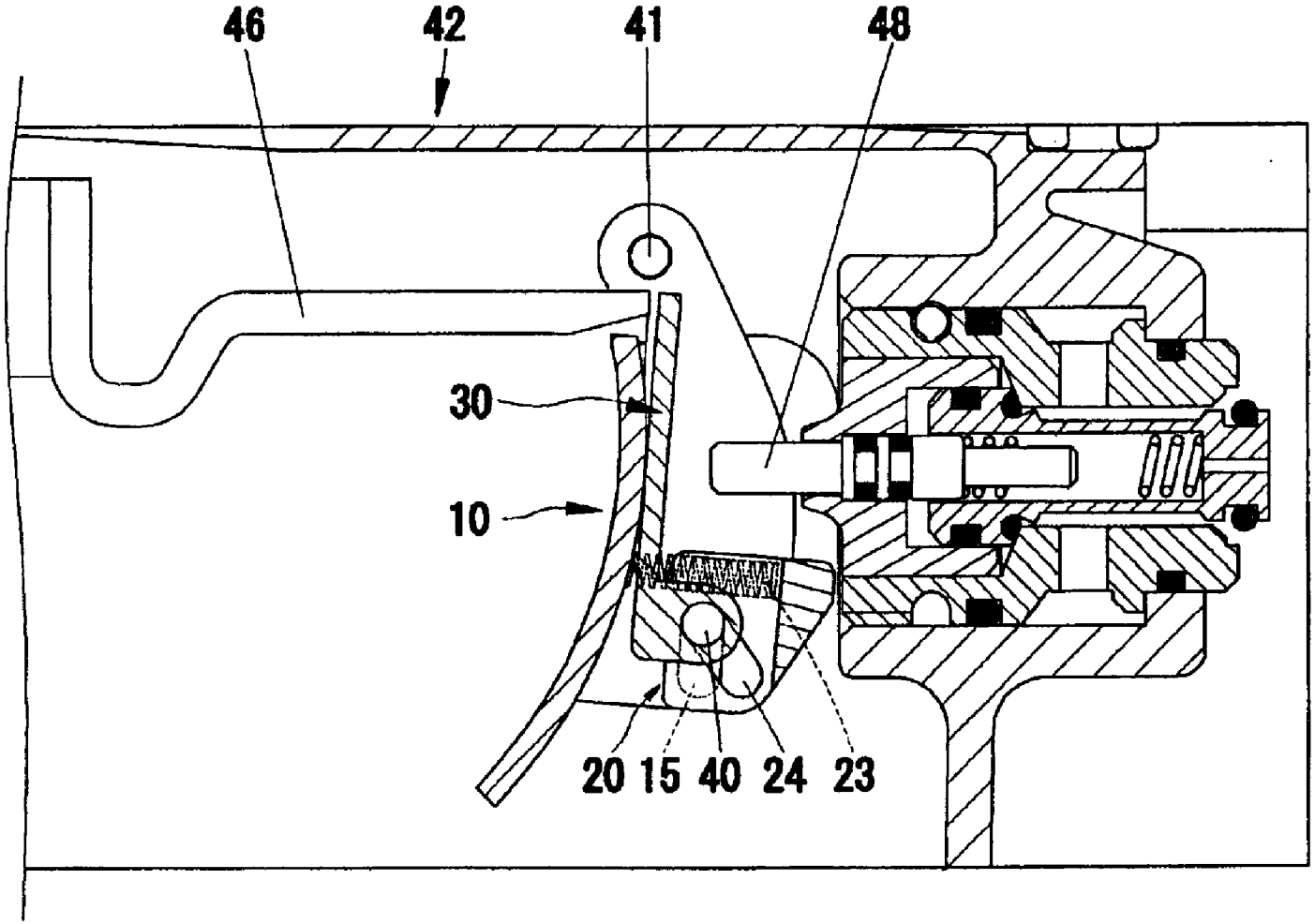
FIGS. 4 to 8 are cross-sectional views of the nail stapler of FIG. 1 in various positions.

Referring to FIG. 3, in assembly, the lower portion 32 of the secondary trigger 30 is put between the side members 21 of the slide 20. Each spring 23 is partially put in each substantially hole 26. The side members 21 of the slide 20 are put between the side members 11 of the major trigger 10. The fins 25 are put in the substantially horizontal slots 14 in a sliding manner. A pin 40 is inserted in the apertures 15, the slots 24 and the aperture 34. The springs 23 are compressed between the side members 21 of the secondary trigger 20 and the middle member 12 of the major trigger 10 as shown in FIG. 4.

A pin 41 is inserted in the aperture 13 of each side member 11 and an aperture 50 defined in the single-shot nail stapler 42. Thus, the major trigger 10 is pivotally connected with the single-shot nail stapler 42. The security element 46 extends between the side members 11. Thus, the security element 46 can be pressed against a piece of wood (not shown) without being hindered by means of the major trigger 10.

Figure 5:
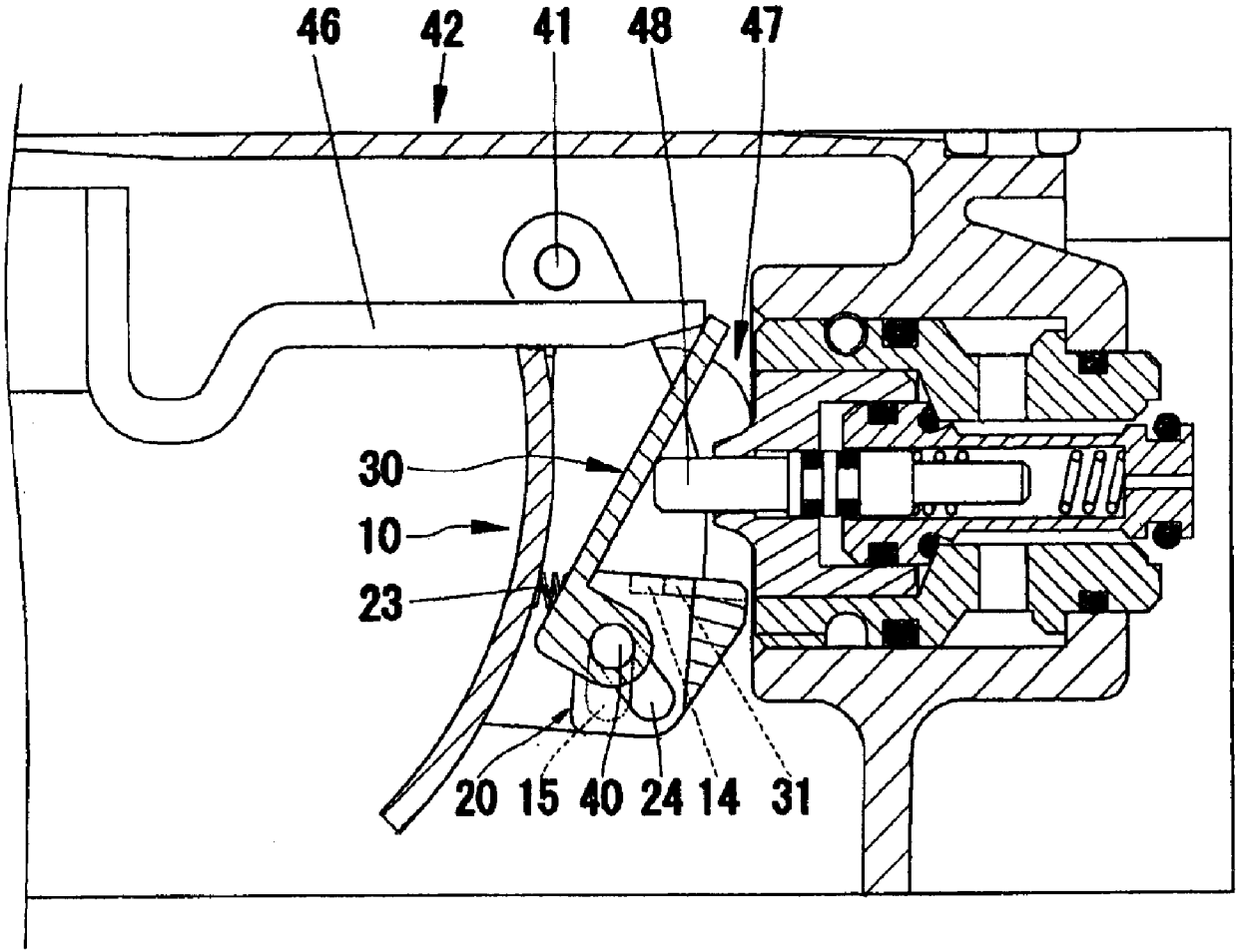

Referring to FIG. 5, an end of the security element 46 is pressed against a piece of wood so that an opposite end of the security element 46 pushes the upper portion 31 of the secondary trigger 30. Thus, the secondary trigger 30 is brought into contact with the valve-opening rod 48. The slide 20 is pushed to the right by means of the springs 23.

Figure 6:
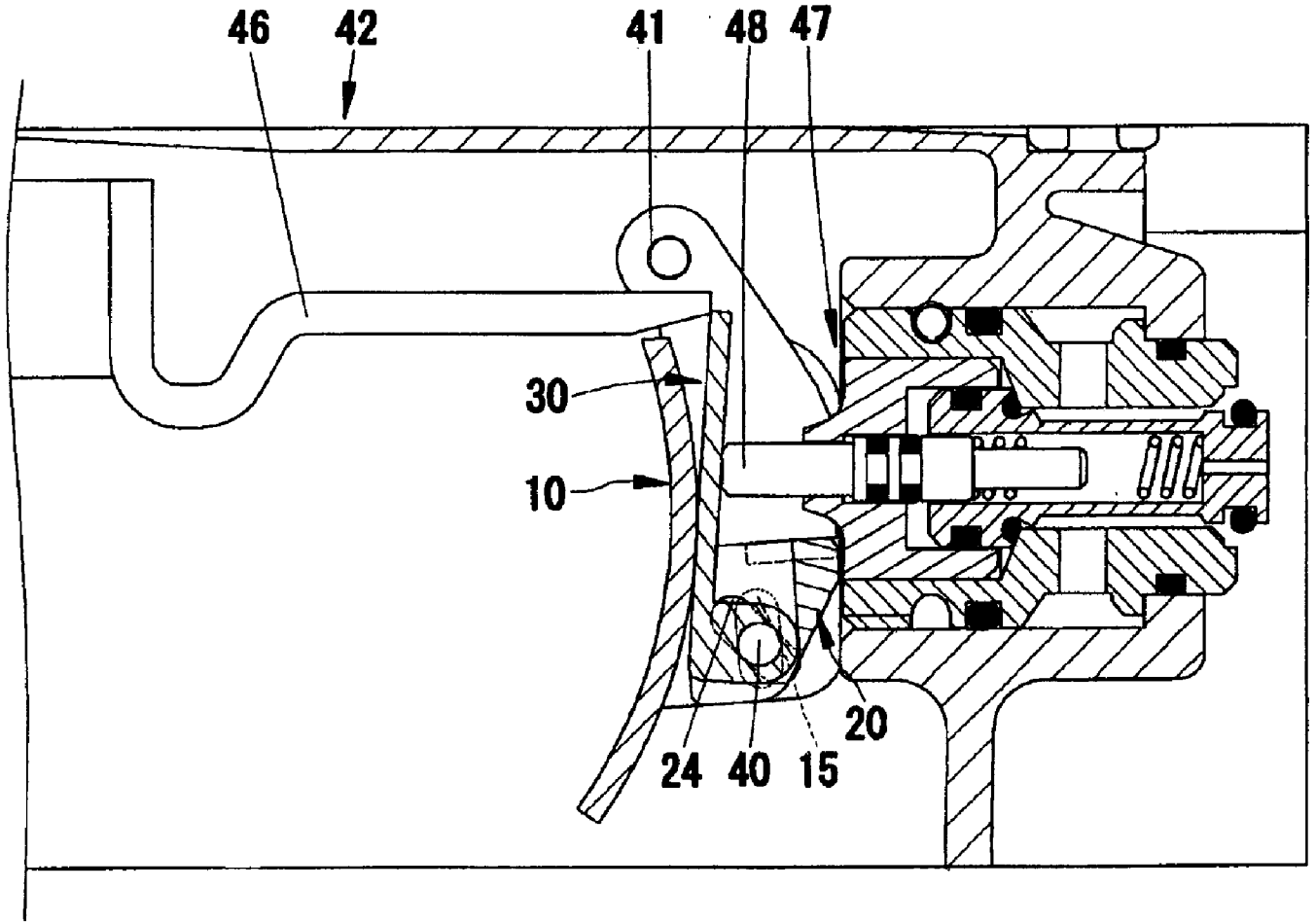

Referring to FIG. 6, the security element 46 is still pressed and the major trigger 10 is pulled. The secondary trigger 30 is pushed by means of the major trigger 10, thus causing the secondary trigger 30 to push the valve-opening rod 48. Thus, the single-shot nail stapler 42 shoots a nail.

Figure 7:
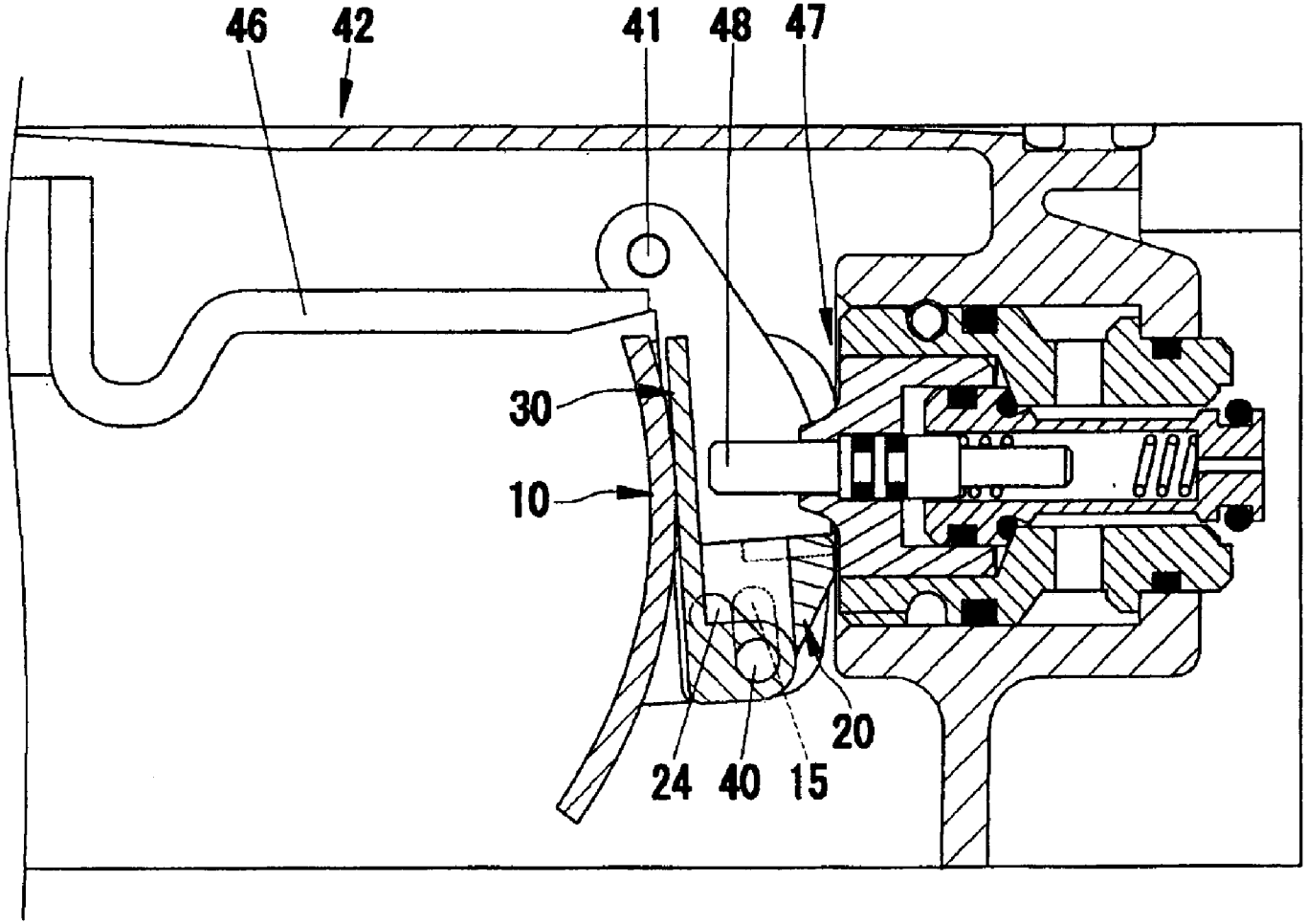

Referring to FIG. 7, the security element 46 is released while the major trigger 10 is still pulled. While the major trigger 10 is pulled, the slide 20 is moved to the right. When the major trigger 10 is pulled to an extent, the slide 20 is brought into contact with the valve 47. While the major trigger 10 is further pulled, the slide 20 is moved to the left relative to the major trigger 10 as the fins 21 slide in the slots 14. Because of the substantially vertical slots 15 and the inclined slots 24, the pin 40 is moved down. Thus, the secondary trigger 30 is moved down.

Figure 8:
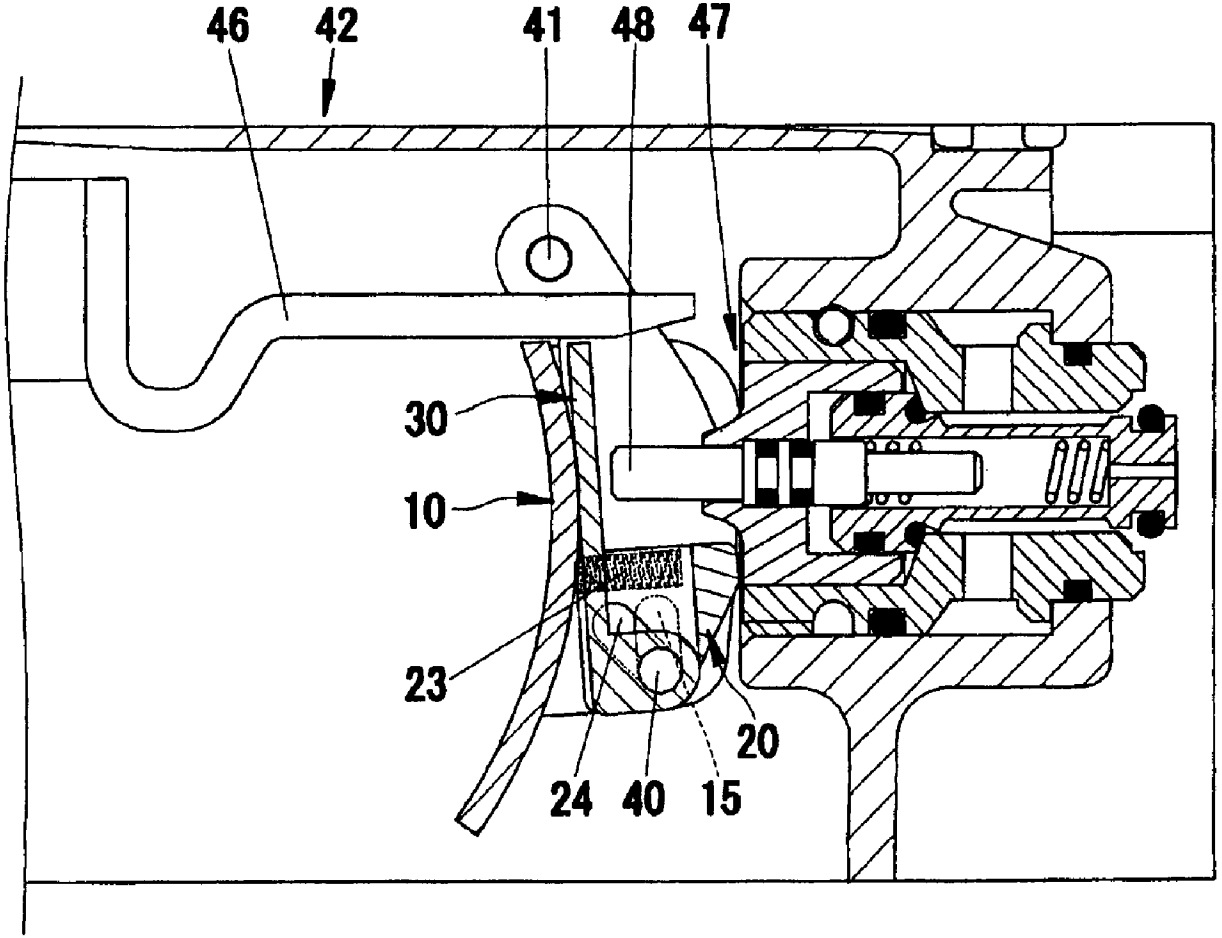
Figure 9:
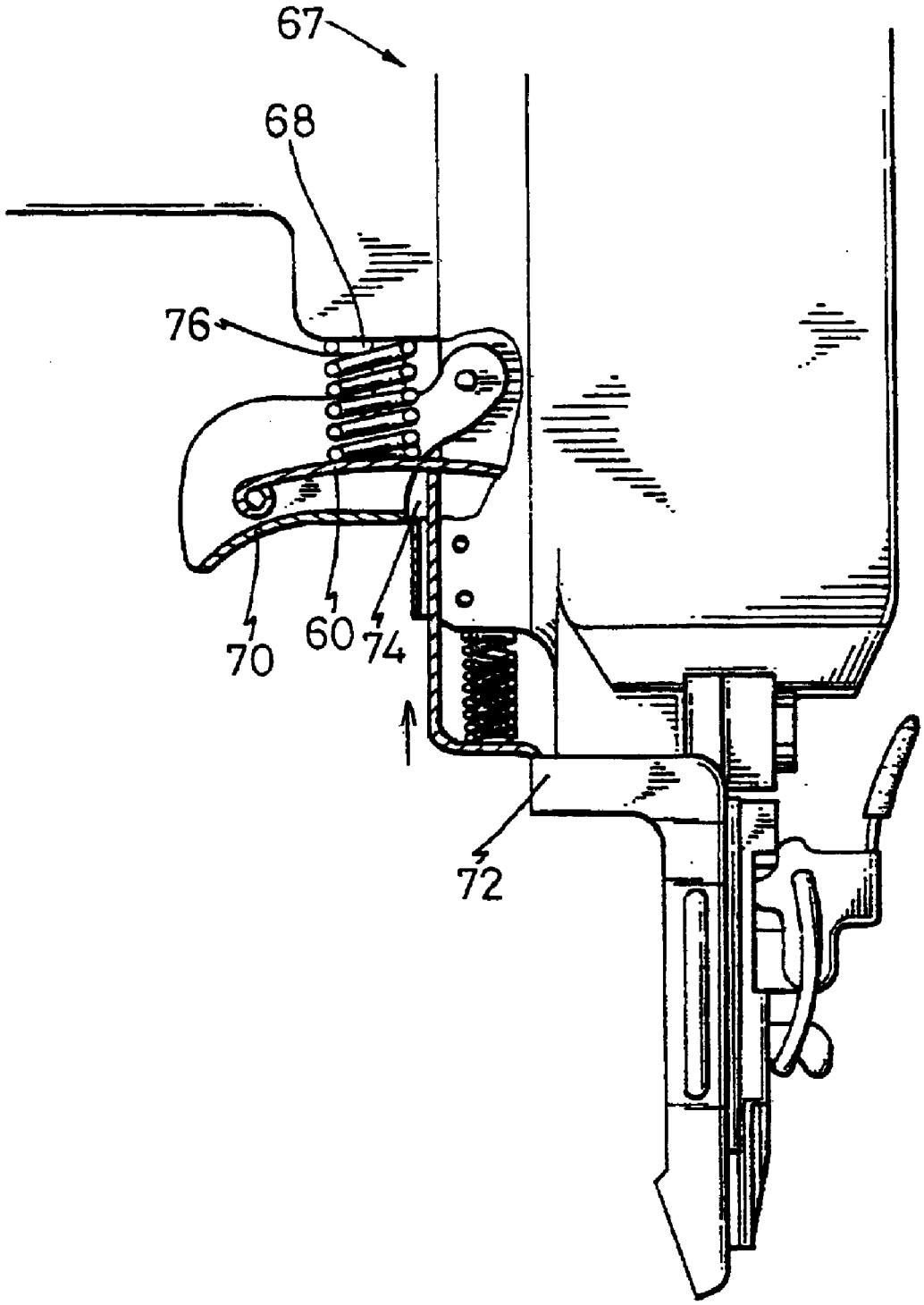
Fig. 9 PRIOR ART
FIGS. 9 to 12 are cross-sectional views of a conventional single-shot nail stapler in various positions.
Figure 10:
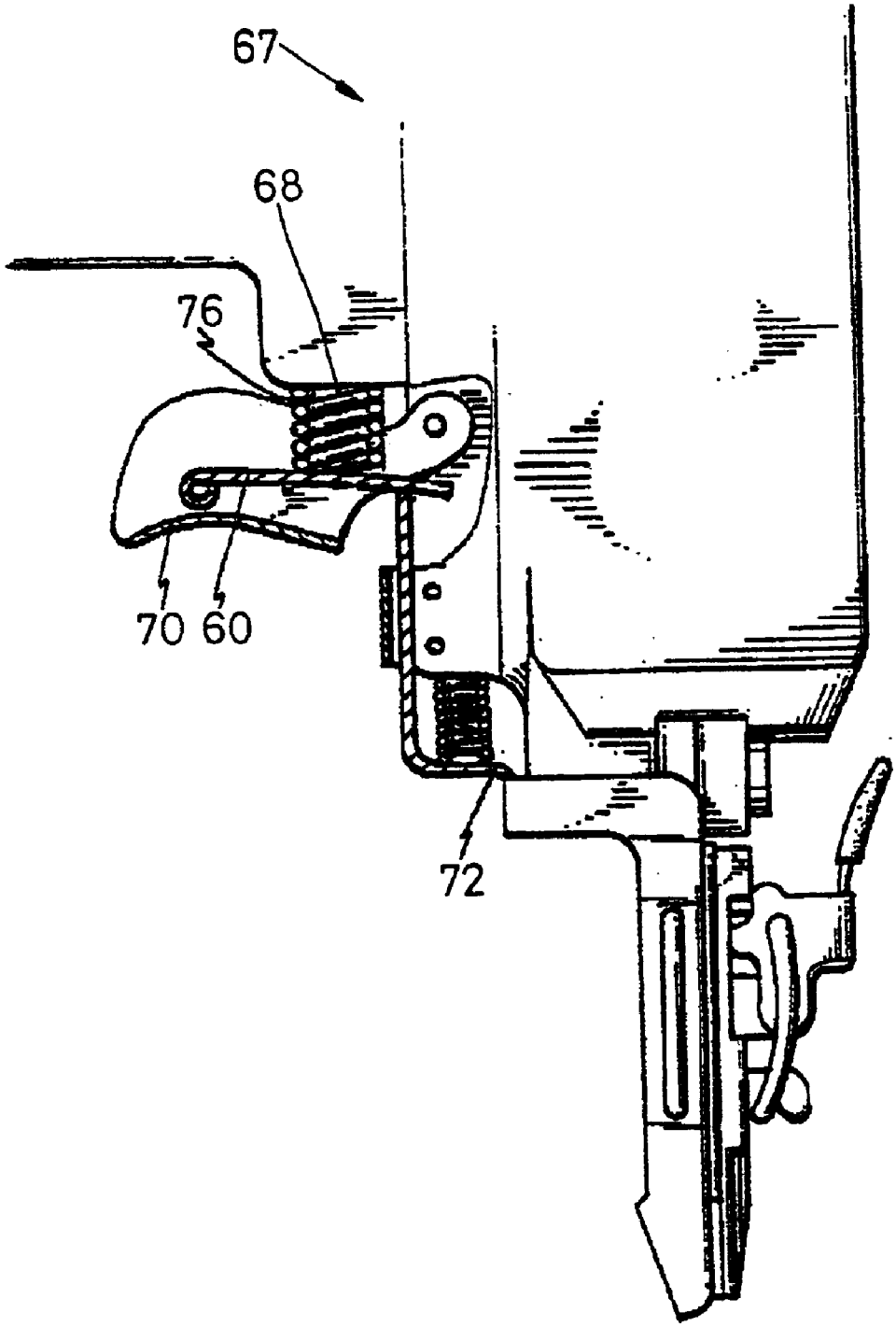
Fig. 10 PRIOR ART
Figure 11:
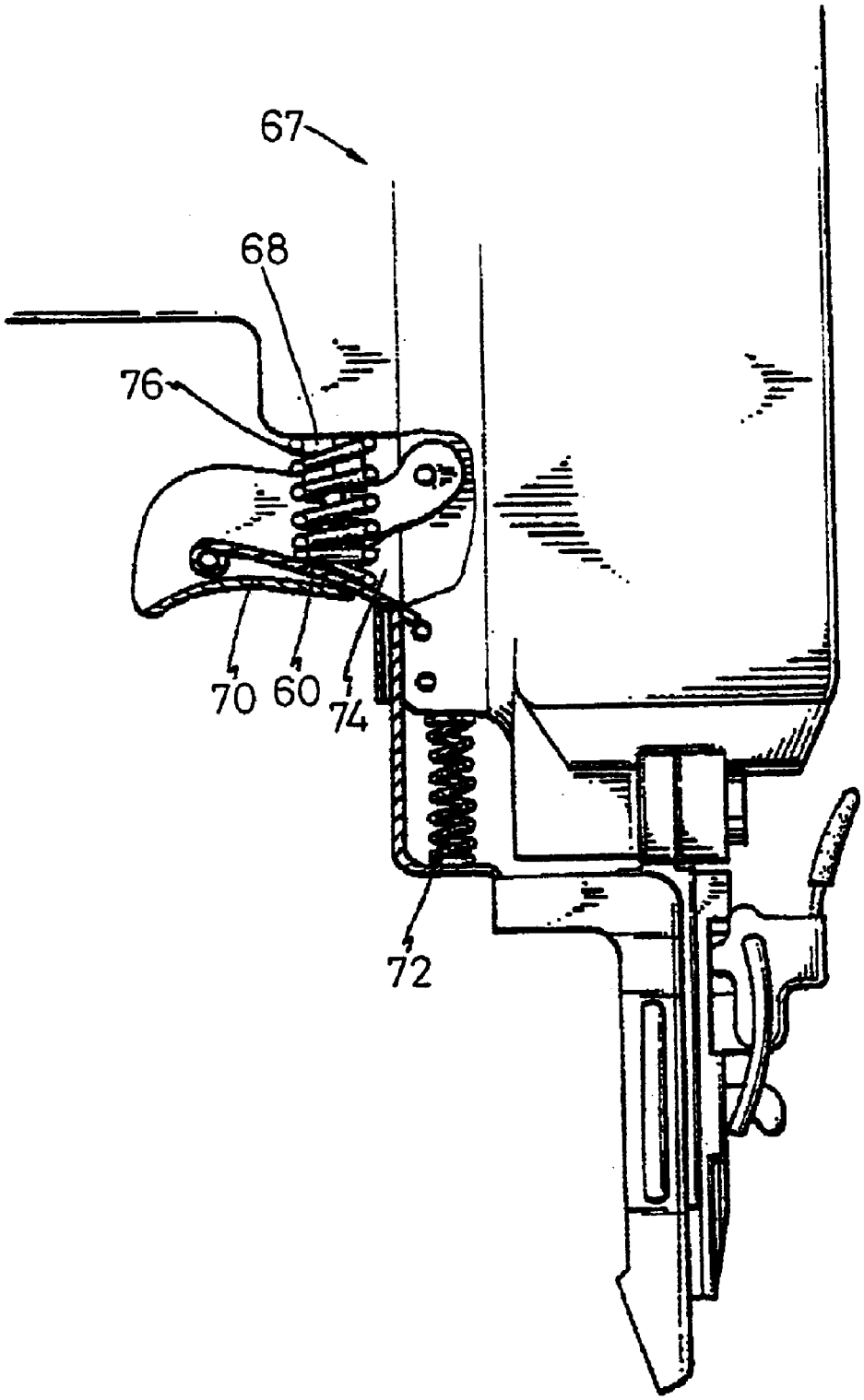
Fig. 11 PRIOR ART
Figure 12:
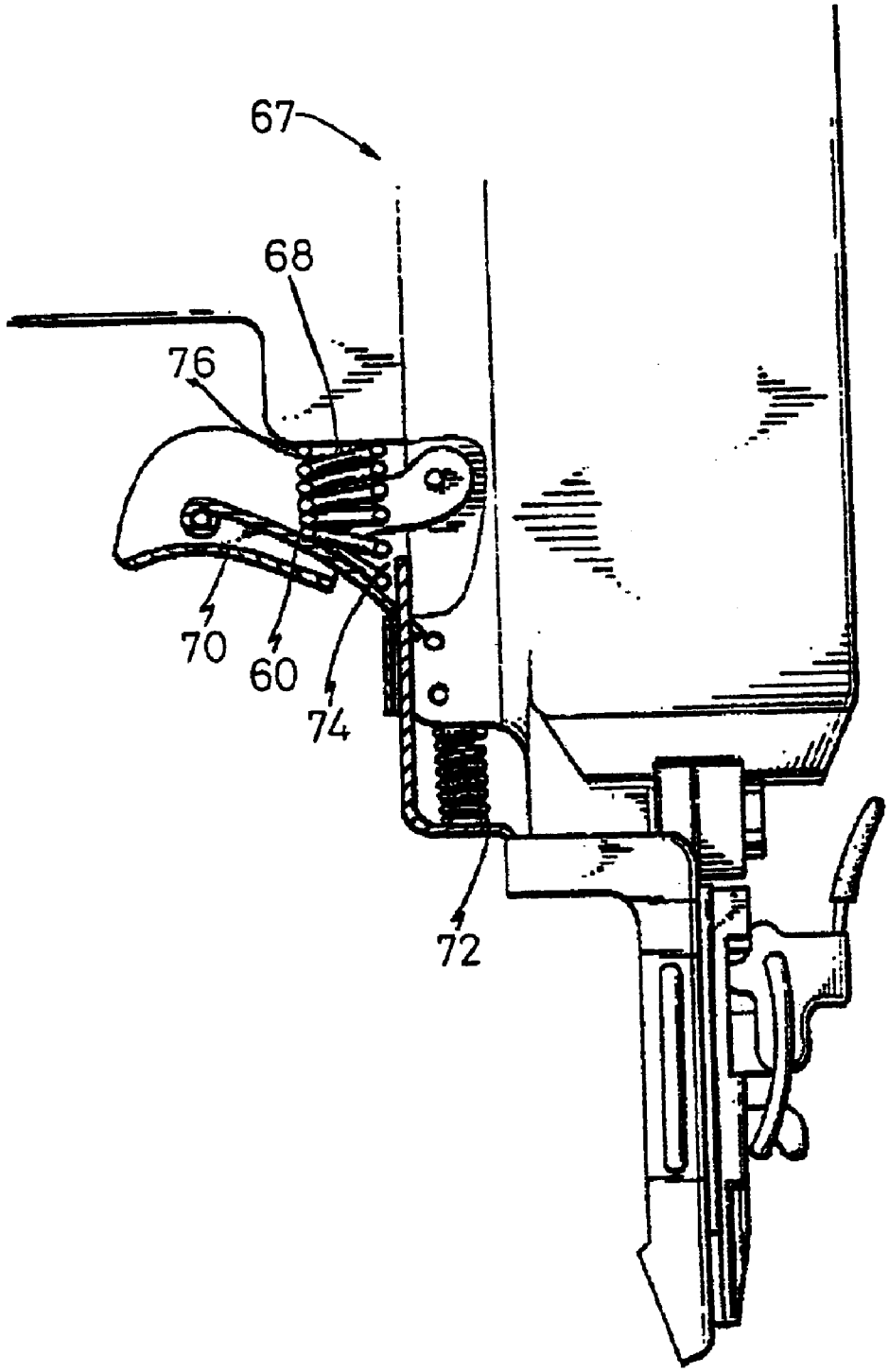
Fig. 12 PRIOR ART
Figure 13:
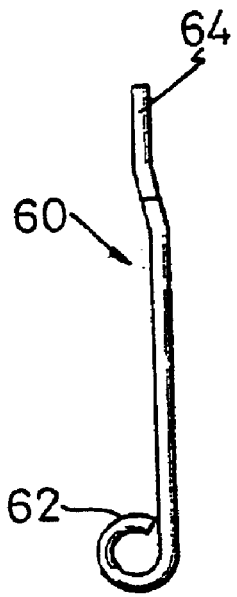
Fig. 13 PRIOR ART
FIG. 13 is a front view of a secondary trigger for use in the single-shot nail stapler of FIGS. 9 to 12.
Figure 14:
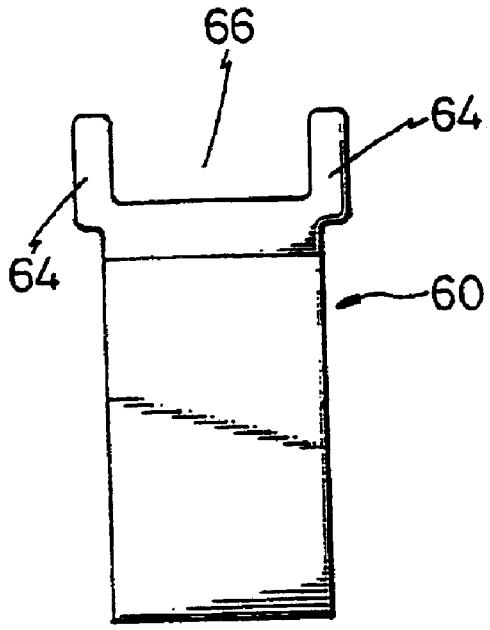
Fig. 14 PRIOR ART
FIG. 14 is a side view of the secondary trigger of FIG. 13.

Referring to FIG. 8, the security element 46 is pressed again and the major trigger 10 is still pulled. As the secondary trigger 30 has been moved down, its upper portion 31 is not pushed by means of the security element 46. Hence, the valve-opening rod 68 is not pushed. Thus, the nail stapler 67 does not shoot another nail.

The present invention has been described via detailed illustration of some embodiments. Those skilled in the art can derive variations from the embodiments without departing from the scope of the present invention. Therefore, the embodiments shall not limit the scope of the present invention defined in the claims.

What is claimed is:

1. A single-shot nail stapler comprising:

a valve;

a valve-opening rod for pushing the valve open;

a major trigger including two side members each with an upper portion pivotally attached to a portion of the single-shot nail stapler and a lower portion defining a substantially horizontal slit and a substantially vertical slot with an upper end and a lower end;

a slide including two side members each including a fin formed thereon and defining an inclined slot with an upper left end and a lower right end, wherein the fins are movable in the substantially horizontal slits of the major trigger;

a secondary trigger including an upper portion, a lower portion and an aperture defined in the lower portion of the secondary trigger;

a pin fit in the aperture of the secondary trigger and movable in the inclined slots of the slide and the substantially vertical slots of the major trigger;

two springs each compressed between the major trigger and each of the slide members of the slide; and a security element extending movably between the side members of the major trigger for pushing the upper portion of the secondary trigger.

2. The single-shot nail stapler according to claim 1 including a pin, wherein each of the side members of the major trigger defines an aperture through which the pin if driven into a portion of the single-shot nail stapler.

3. The single-shot nail stapler according to claim 1 wherein each of the side members of the slide defines a substantially horizontal hole for receiving an end of each of the springs.

4. The single-shot nail stapler according to claim 1 wherein the upper portion of the secondary trigger is a flat portion.

* * * * *